US009004631B1

(12) United States Patent
Folkins et al.

(10) Patent No.: US 9,004,631 B1
(45) Date of Patent: Apr. 14, 2015

(54) METHOD AND APPARATUS FOR ACCUMULATING EXCESS INK IN A STATIONARY RECEPTACLE IN IMAGING DEVICES THAT FORM IMAGES ON INTERMEDIATE IMAGING SURFACES

(71) Applicant: Xerox Corporation, Norwalk, CT (US)

(72) Inventors: Jeffrey J. Folkins, Rochester, NY (US); David Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/068,675

(22) Filed: Oct. 31, 2013

(51) Int. Cl.
*B41J 29/38* (2006.01)
*B41J 2/125* (2006.01)
*B41J 11/04* (2006.01)

(52) U.S. Cl.
CPC . *B41J 2/125* (2013.01); *B41J 11/04* (2013.01)

(58) Field of Classification Search
CPC .. B41J 2/04541; B41J 2/0458; B41J 2/04581; B41J 2/04588; B41J 2/04543
USPC ..... 347/9
See application file for complete search history.

(56) References Cited

U.S. PATENT DOCUMENTS 4,369,456 A 1/1983 Cruz-Uribe et al.
4,831,419 A 5/1989 Iaia, Jr. et al.
6,382,850 B1 5/2002 Freund et al.
6,497,522 B2 12/2002 Wotton et al.
7,182,334 B2 2/2007 Spence et al.
7,524,050 B2 4/2009 Baker et al.
7,771,039 B2 8/2010 Sakagami
7,832,853 B2 11/2010 Nakashima
8,246,140 B2 8/2012 Maekawara et al.
8,382,242 B2 2/2013 Rosati et al.
8,459,772 B2 6/2013 Katoh et al.
2007/0165092 A1 7/2007 Kito
2007/0236535 A1* 10/2007 Baker et al. ..... 347/36
2008/0166495 A1* 7/2008 Maeno et al. ..... 427/493
2009/0015627 A1* 1/2009 Takahashi ..... 347/32
2009/0122107 A1* 5/2009 Ray et al. ..... 347/37
2011/0254893 A1* 10/2011 Ikagawa et al. ..... 347/22

FOREIGN PATENT DOCUMENTS

EP 0195863 B1 10/1986
EP 0873877 A2 10/1998

* cited by examiner

*Primary Examiner* — Manish S Shah
*Assistant Examiner* — Yaovi Ameh
(74) *Attorney, Agent, or Firm* — Maginot Moore & Beck LLP

(57) ABSTRACT

A mechanism enables inkjets in a printhead to be operated to eject ink in an effort to replace ink exposed to ambient conditions with ink from within the printhead. The mechanism includes a controller configured to operate an intermediate imaging member to rotate to align a plurality of apertures with inkjets on a printhead. The inkjets are operated to eject ink through the plurality of apertures and ink from within the printhead replaces the ejected ink without impacting the formation of subsequent ink images.

12 Claims, 9 Drawing Sheets

METHOD AND APPARATUS FOR ACCUMULATING EXCESS INK IN A STATIONARY RECEPTACLE IN IMAGING DEVICES THAT FORM IMAGES ON INTERMEDIATE IMAGING SURFACES

TECHNICAL FIELD

This disclosure relates generally to imaging devices that form images on intermediate imaging surfaces for transfer to media, and more particularly, to operating inkjets in such imaging devices to help prevent ink from drying in the inkjets.

BACKGROUND

In various printing technologies, marking material is applied to an intermediate imaging surface of a rotating structure, such as a belt or a drum. Print media are then pressed against the intermediate imaging surface to transfer the image from the intermediate imaging surface to the print media. In one example using phase change inkjet printing, ink is deposited to form an image on the surface of an imaging drum. A transfix roller presses the print media against the image-bearing drum surface to transfer the ink image from the drum surface to the print media to the print media.

By way of example, FIG. 9 shows a schematic view of a portion of an exemplary inkjet printing apparatus 10 of the prior art. The printing apparatus 10 is a phase change inkjet print mechanism. In a phase change inkjet printer, ink is delivered to the printer in a solid form. A melting device in the printer heats the solid ink to its melting temperature to form liquid ink, which is then delivered to an inkjet printhead 14. The inkjet printhead 14 ejects drops of the liquid ink from a plurality of inkjet inkjets onto an intermediate imaging surface 18, which is depicted as a liquid pre-coated rotating drum in the figure for purposes of illustration. After the printhead 14 forms the image on the surface of the intermediate imaging surface 18, a transfix mechanism moves a transfix roller 22 into engagement with the drum surface 18 as a media sheet 26 approaches the nip formed by the transfix roller 22 and the drum surface 18. As the media sheet travels through the nip in synchronization with the ink image on the surface 18, the image is transferred from the intermediate imaging surface 18 to the media sheet 26. This transfer process is called a transfix process because the image is simultaneously transferred and bonded (or fixed) to the media sheet 26. Other mechanisms are also known for transferring marking material images on intermediate imaging surfaces to media.

Sometimes ink at an inkjet nozzle of a printhead 14 can degrade with time. For example, aqueous ink can dry in an aperture and clog the inkjet. The drying of ink in an inkjet can occur because the inkjet has not been fired for some period of time. Loss of the inkjet can negatively affect the quality of printed images. To help prevent inkjets from clogging because ink dries in the inkjet, the inkjets in a printhead can be operated to eject ink in an effort to replace ink exposed to ambient conditions with ink from within the printhead. This ejected ink is not used to produce a printed image. Thus, while this process is useful, the ejected ink that is not part of an image needs to be removed without impacting the formation of subsequent ink images. Accordingly, a mechanism for collecting ink from inkjets that were operated to keep relatively fresh ink at the inkjet inkjets would be useful.

SUMMARY

A printer having an intermediate imaging surface accumulates ink that was ejected to keep relatively fresh ink at the inkjets of the inkjets within the printer. The printer includes at least one printhead, at least on support member, a substrate, and a stationary receptacle. The at least one printhead is configured with a plurality of inkjets to eject ink drops. The at least one support member is positioned opposite the at least one printhead. The substrate is configured to rotate about the support member to enable the substrate to pass by the at least one printhead in a process direction. The substrate includes a first area in which ink drops ejected from the at least one printhead form a first ink image on the substrate for transfer to media and a second area having a plurality of apertures configured to enable ink drops ejected from the at least one printhead to pass through the substrate. The second area extends across a width of the substrate in a cross-process direction and along a portion of the substrate in the process direction to interrupt the first area. The stationary receptacle is positioned on a side of the substrate that is opposite a side of the substrate facing the at least one printhead. The stationary receptacle also extends across the substrate in a cross-process direction and is configured to accumulate ink drops ejected by the at least one printhead that passed through apertures in the plurality of apertures in the substrate.

A method operates a printer to accumulate ink that was ejected to keep relatively fresh ink at the inkjets of the inkjets within the printer having an intermediate imaging surface. The method includes operating at least one printhead to eject ink drops and rotating a substrate about a support member to enable the substrate to pass by the at least one printhead in a process direction. The substrate includes a first area in which ink drops ejected from the at least one printhead form a first ink image on the substrate for transfer to media and a second area having a plurality of apertures that enable ink drops ejected from the at least one printhead to pass through the substrate. The second area has a width in a cross-process direction that extends substantially across the substrate and a length in the process direction to interrupt the first area. The method further includes accumulating ink drops ejected by the at least one printhead that passed through apertures in the plurality of apertures in the substrate in a stationary receptacle positioned on a side of the substrate that is opposite a side of the substrate facing the at least one printhead.

BRIEF DESCRIPTION OF THE DRAWINGS

The foregoing aspects and other features of a printer having an intermediate imaging surface that accumulates ink ejected to keep relatively fresh ink at the inkjets of inkjets are explained in the following description, taken in connection with the accompanying drawings.

DETAILED DESCRIPTION

Figure 1:
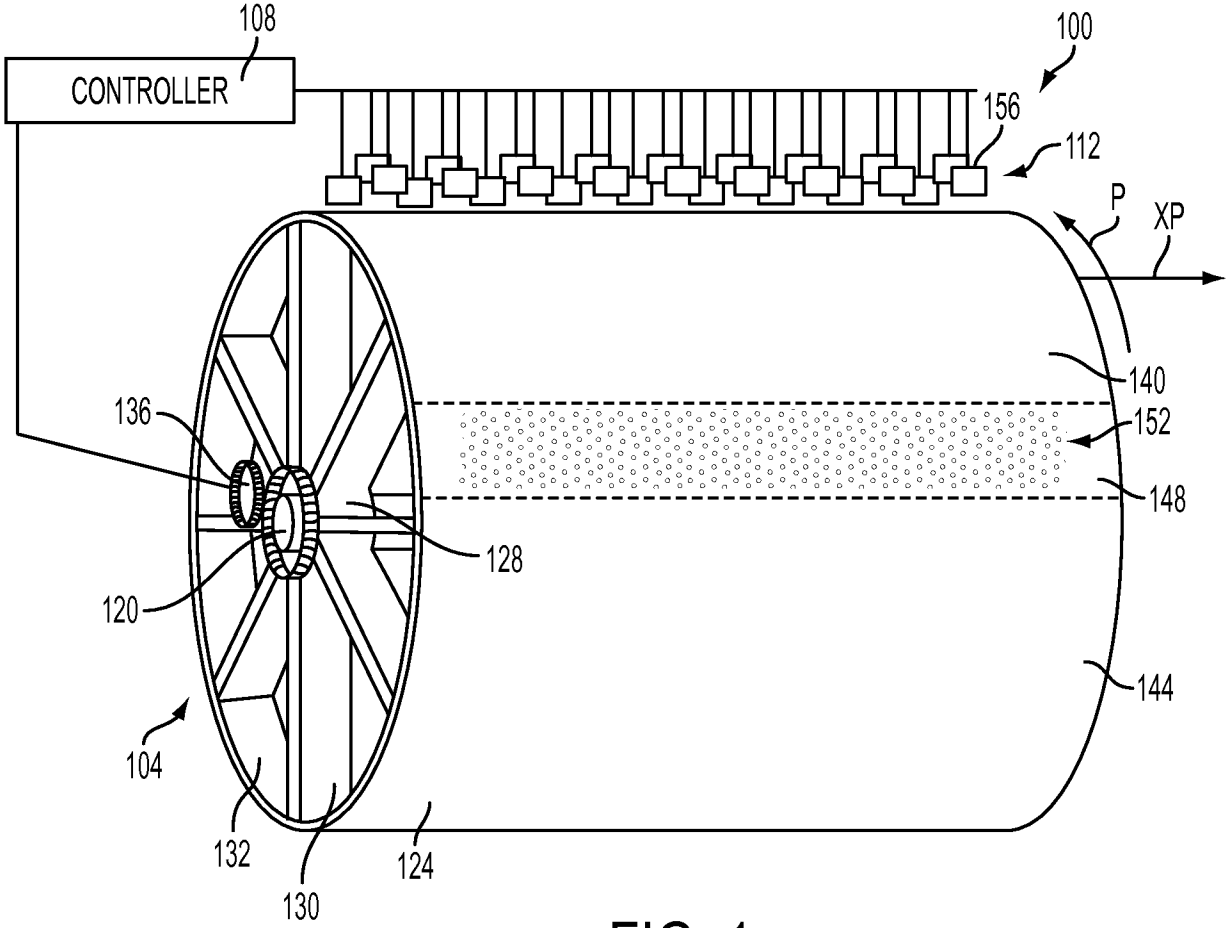
FIG. 1 is a side perspective view of a portion of a printing system including a first embodiment of an intermediate imaging assembly.

For a general understanding of the environment for the system and method disclosed herein and the details for the system and method, reference is made to the drawings. In the drawings, like reference numerals have been used throughout to designate like structure. As used herein, the words "printer," "printing system," and "imaging apparatus", which may be used interchangeably, encompasses any apparatus that performs a print outputting function for any purpose, such as a digital copier, bookmaking machine, facsimile machine, a multi-function machine, etc. Furthermore, a printer is an apparatus that produces images with marking material on media and fixes and/or cures the images before the media exits the printer for collection or further printing by a subsequent printer.

Figure 2:
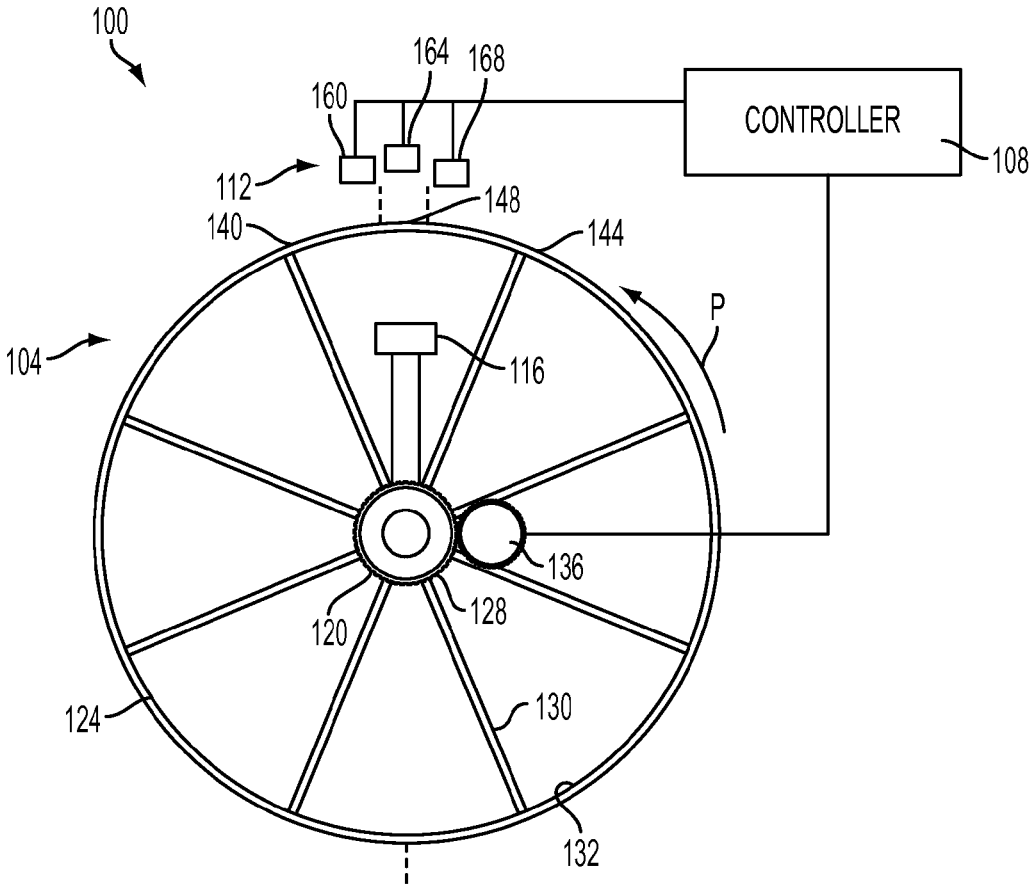
FIG. 2 is an end view of the intermediate imaging assembly of FIG. 1.

Referring to FIG. 1 and FIG. 2, one embodiment of an intermediate imaging assembly 100 is shown. The assembly 100 includes an imaging drum 104, a controller 108, a plurality of printheads 112, and a stationary receptacle 116 (visible in FIG. 2). The controller 108 is operatively connected to the plurality of printheads 112 and to the imaging drum 104 via an actuator 136.

The imaging drum 104 includes a stationary support member 120 and a rotating intermediate imaging surface in the form of a surface member 124. The support member 120 is a shaft that extends axially through a hollow axial cylinder formed by the surface member 124. The surface member 124 includes a pair of hubs 128, one of which is shown in FIG. 1, with spokes 130 that extend from the hubs 128 to a circumferential wall 132 of the surface member 124 at each end of the surface member 124. One of the hubs 128 is operatively connected to the actuator 136 that is operated by the controller 108 to rotate the hubs 128, spokes 130, and circumferential wall 132 about the support member 120 in a process direction P. In the present embodiment, the hubs 128 are operatively connected to the actuator 136 by the engagement of the teeth on the hubs 128 with the teeth on the actuator 136. Other manners of operatively connecting the hubs 128 to the actuator 136, however, are also possible. In the present embodiment, the actuator 136 is configured to engage one of the hubs 128. Alternatively, the actuator 136 can engage both hubs 128 or engage another portion of the surface member 124.

The circumferential wall 132 includes a first area 140, a second area 144, and a third area 148, shown as separated from one another by dashed lines for purposes of illustration only. The first area 140 and the second area 144 are contiguous except where they are interrupted by the third area 148. They are depicted as separate areas since each area 140 and 144 is large enough for an ink image to be formed in these areas with ink received from the printheads. The circumferential wall can be viewed as a first area, which is comprised of the first and second areas, interrupted by the third area. The third area 148 receives ink ejected from the printheads for the purpose of removing ink from an inkjet nozzle and replacing it with ink from within the printhead. Consequently, these drops of ejected ink do not form an ink image. The third area 148 includes a plurality of apertures 152 (shown in FIG. 1) arranged to extend across a substantial amount of circumferential wall 132 in a cross-process direction XP (shown in FIG. 1) in the third area 148. The apertures 152 are arranged in staggered rows to help preserve the structural integrity of the circumferential wall 132 and the surface member 124 even though a substantial amount of the surface member 124 in the third area 148 includes apertures 152.

As shown in FIG. 1, as an illustrative example, the plurality of printheads 112 includes twenty-seven printheads 156 arranged in three staggered rows of nine printheads each. As shown in FIG. 2, the printheads 156 in each of the three rows 160, 164, 168 are aligned with one another such that only the first printhead 156 in each row is visible from an end view. The staggered arrangement enables the printheads 156 to form an image across substantially the full width of the imaging drum 104 in the cross-process direction XP (shown in FIG. 1). Other arrangements of the plurality of printheads including different numbers and alternative placements of printheads are also possible.

Each printhead 156 has a corresponding front face including a plurality of inkjets for ejecting drops of ink onto the circumferential wall 132 of the imaging drum 104. Each inkjet corresponds to at least one aperture 152 (shown in FIG. 1) in the third area 148 of the circumferential wall 132 such that each inkjet on a printhead 156 can be aligned with an aperture 152 when the plurality of printheads 112 is aligned with the third area 148. Each aperture 152 is larger than the average size of a drop of ink. In various embodiments, each aperture 152 can have a diameter from about twice the diameter of a drop of ink to about 100 times the diameter of a drop of ink, with most embodiments having apertures in the about 10 times to about 100 times the diameter of an ink drop. When inkjets on a printhead 156 are approaching apertures 152, the inkjets are activated to eject through the apertures 152 as the apertures are opposite the inkjets and, therefore, through the circumferential wall 132. Depending on the size of the apertures, multiple inkjets can be aligned with a given aperture at a single time or the aperture can pass multiple inkjets as it passes the printhead assembly. Additionally, if multiple inkjets are aligned in the same cross process direction, for example, in a multiple sequential color printer, the similarly aligned inkjets can utilize the same aperture. Thus, the number of apertures and the number of inkjets are not the same since different inkjets can eject ink through the same aperture either simultaneously or during the same pass of the third area past the printhead assembly.

As shown in FIG. 2, the stationary receptacle 116 is fixedly supported by the support member 120 and is arranged within the circumferential wall 132 of the surface member 124. The stationary receptacle 116 is fixedly positioned in alignment with the plurality of printheads 112 and the circumferential wall 132 is interposed between the plurality of printheads 112 and the stationary receptacle 116. In the present embodiment, the stationary receptacle 116 is a tray configured to accumulate ink drops ejected by the inkjets that pass through the apertures 152 (shown in FIG. 1) in the third area 148 of the circumferential wall 132. Other container configurations that accumulate the ink drops ejected through the third area 148 are also possible.

The controller 108 is configured to rotate the surface member 124 about the support member 120 in the process direction P by sending electronic signals to the actuator 136 to selectively operate the actuator 136 to engage and rotate the hub 128. The controller 108 is also configured to operate each printhead 156 in the plurality of printheads 112 to selectively eject ink from inkjets onto the circumferential wall 132 of the surface member 124 by sending electronic signals to the inkjets in the printheads 156. The controller 108 operates the actuator 136 and the inkjets in the plurality of printheads 112 so that inkjets selectively eject ink onto the first area 140, the second area 144, or the third area 148 of the circumferential wall 132. In particular, the controller 108 selectively operates the actuator 136 to rotate the surface member 124 and simultaneously selectively operates the printheads 156 to eject ink onto a particular area of the circumferential wall 132 by ejecting ink when the printheads 156 are aligned with each of the first area 140, the second area 144, and the third area 148 of the surface member 124. In at least one embodiment, the controller 108 is also configured to operate the printheads 156 to selectively eject ink onto the third area 148 at a predetermined rate. In at least one embodiment, the controller 108 is configured to determine when a predetermined amount of time has passed since an inkjet in a printhead 156 was last operated to eject ink.

In operation, the printer is operated to form ink images on the first and the second areas and to eject ink drops through the apertures in the third area to help prevent ink from clogging the inkjet apertures in the printheads. When the printer is operated to form ink images, the controller 108 sends electronic signals to the actuator 136 to rotate the surface member 124 about the support member 120 in the process direction P such that the circumferential wall 132 rotates relative to the plurality of printheads 112 in the process direction P. The controller 108 also sends electronic signals to operate the inkjets in the printheads 156 to selectively eject ink onto the circumferential wall 132. When the first area 140 and the second area 144 of the circumferential wall 132 are aligned with the plurality of printheads 112, the controller 108 operates the inkjets with reference to image data to eject ink onto the circumferential wall 132 to form printed images in the first and the second areas that correspond to the image data. The controller 108 operates the inkjets in the printheads 156 to eject ink drops into the apertures in the third area 148 of the circumferential wall 132 to help prevent ink from clogging the inkjets in a manner described below.

As the third area approaches the plurality of printheads 112, the controller 108 operates the inkjets in the printheads 156 to eject ink from inkjets in an effort to replace ink exposed to ambient conditions for a predetermined period of time with ink from within the printheads 156. As the inkjets of a printhead 156 are approaching alignment with the corresponding apertures 152 in the third area 148, the controller 108 sends electronic signals to inkjets in the printheads 156 to eject drops of ink from the inkjets. The drops of ink ejected by the inkjets into the third area are not used to produce a printed image on the circumferential wall 132. Instead, the ejected drops of ink pass through apertures 152 in the circumferential wall 132 and are received within the stationary receptacle 116 positioned opposite the printheads 156. By ejecting this ink that is not used to form a printed image through the apertures 152 in the surface member 124, the inkjets on the printheads 156 can replace the ink exposed to ambient conditions for the predetermined time period with ink from within the printheads 156.

As depicted in FIG. 2, the third area 148 is opposite only one row 160, 164 or 168 of printheads 156 at a time; however, the third area could be longer in the process direction so the apertures in the third area are opposite more than one row of printheads at a time. Because the printheads in each row of printheads are staggered with respect to the printheads in the other rows, as is well known, the apertures could be arranged in a similar staggered pattern or the third area could have apertures that cover the width of the print zone in the cross-process direction. In embodiments in which the third area has apertures across the width of the print zone in the cross-process direction, inkjets operated when the third area is opposite the printheads 156 in one row of printheads eject ink drops through portions of the third area opposite those printheads and the inkjets operated in the next row of printheads eject ink drops through different portions of the third area. Having the apertures extend across the width of the print zone in the cross-process direction enables the third area 148 to be shorter in the process direction that an arrangement of apertures that follows the staggered arrangement of the printheads in at least two of the rows of printheads. Another benefit of this arrangement is that fewer apertures 152 need be formed in the circumferential wall 132 thereby allowing the structural integrity of the circumferential wall 132 to be better maintained. Additionally, the apertures in the third area can be arranged in a pattern that corresponds to the arrangement of apertures in the row of printheads.

Figure 7:
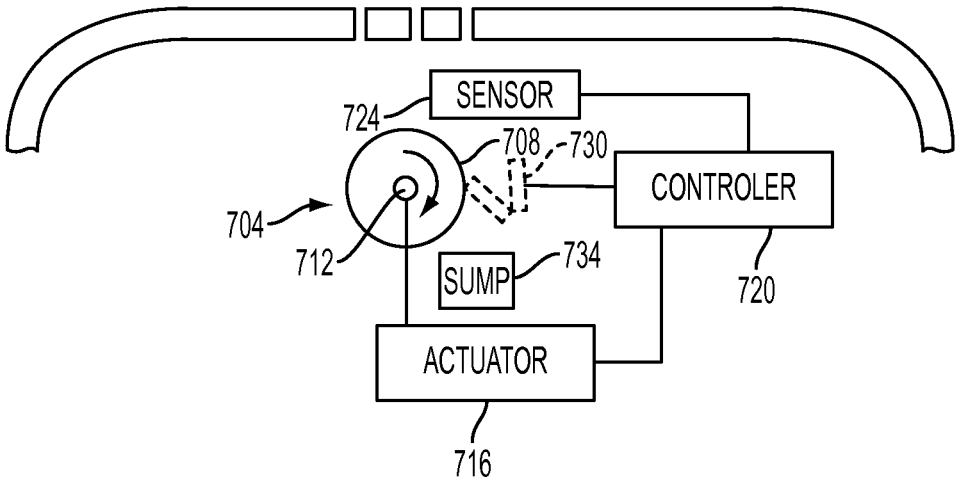
FIG. 7 is a flow diagram depicting a first process for operating the printing system of FIG. 1.
Figure 8:
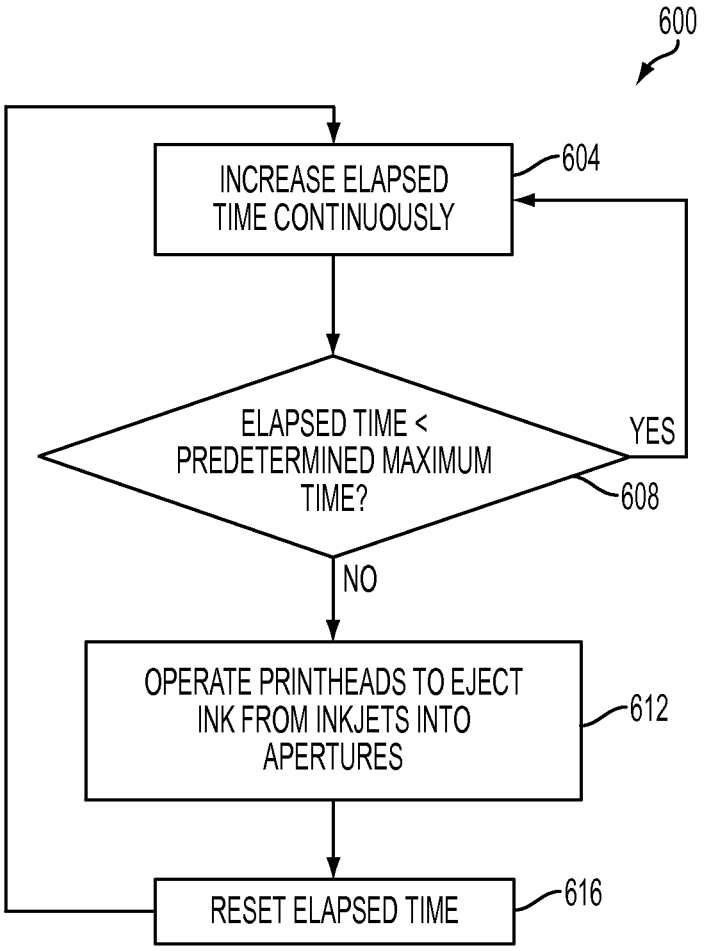
FIG. 8 is a flow diagram depicting a second process for operating the printing system of FIG. 1.
Figure 9:
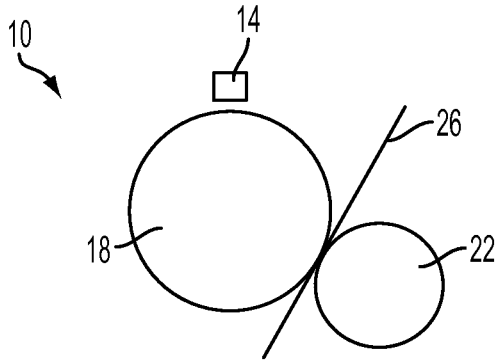
FIG. 9 PRIOR ART
FIG. 9 is a schematic view of a portion of a prior art inkjet printing apparatus including an intermediate imaging surface.

In one embodiment, shown in the flow diagram of FIG. 7, the controller 108 performs a process 500 to determine when to eject an ink drop into an aperture in the third area to replace the ink in the inkjet that has been exposed to ambient conditions for a predetermined time. The controller is configured with programmed instructions to implement the process stored in a memory that is operatively connected to the controller. By executing the stored programmed instructions, the controller operates one or more electronic components operatively connected to the controller to perform the process. In process 500, the controller maintains a timer for each inkjet in each printhead 156, and the timer is continuously updated (504). Upon the operation of an inkjet to eject an ink drop for formation of an ink image in the first or the second area (512), the timer is reset (516). If any timer reaches a predetermined maximum time (508), the inkjet is operated to eject an ink drop into an aperture when the third area and a corresponding aperture are opposite the inkjet (512). The predetermined maximum time corresponds to a period of time short of the time at which ink in the nozzle of the inkjet can dry and clog the inkjet. In another embodiment, shown in the flow diagram of FIG. 8, timers for each inkjet are not maintained. Instead, the controller 108 is configured to operate the inkjets in the printheads 156 at some predetermined frequency to eject ink drops into apertures in the third area so that all inkjets in the printheads 156 are periodically operated. The controller 108 increases an elapsed time continuously (604). When the elapsed time reaches a predetermined elapsed time (608), the printheads are operated to eject ink drops from the inkjets into corresponding apertures (612) and the elapsed time is reset (616). The predetermined elapsed time corresponds to a period of time short of the time at which ink in the nozzle of the inkjet can dry and clog the inkjet. Additionally, in other embodiments, the controller 108 can operate in various manners to determine when particular printheads 156 should be operated to eject ink through the apertures 152.

Figure 3:
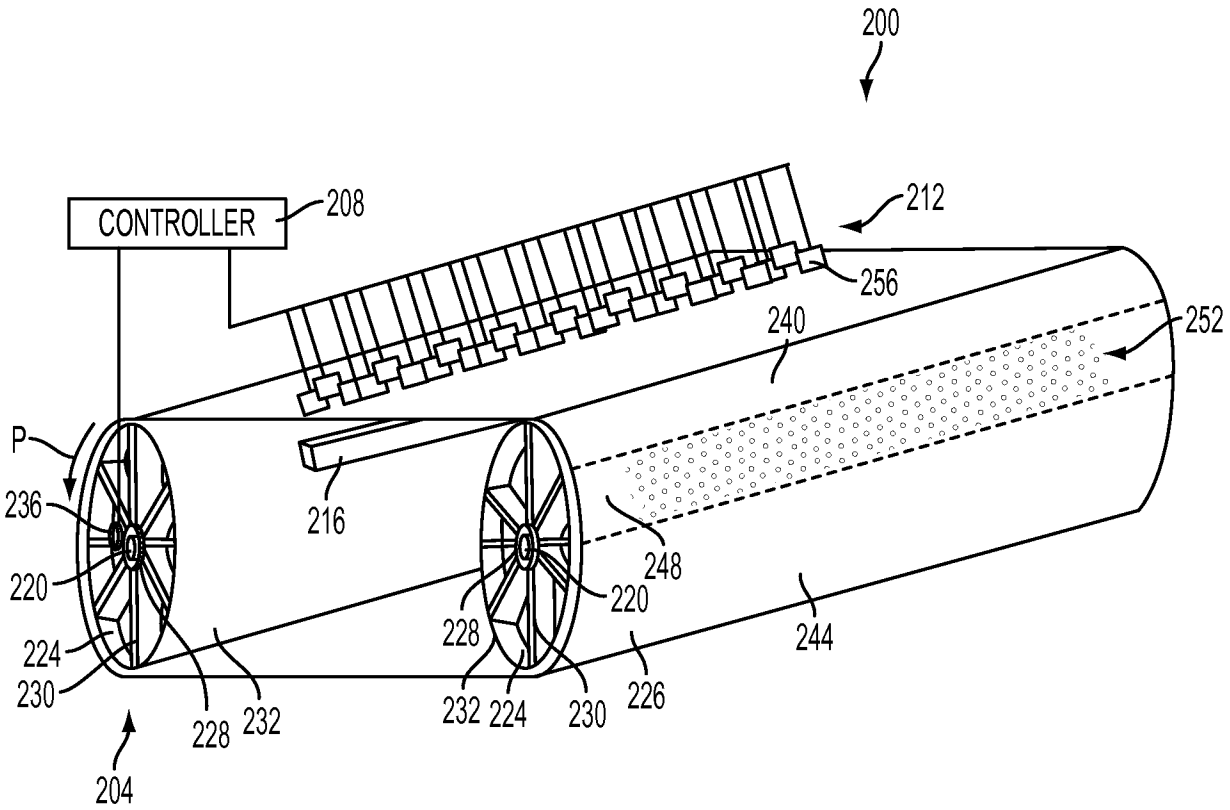
FIG. 3 is a side perspective view of a portion of a printing system including a second embodiment of an intermediate imaging assembly.
Figure 4:
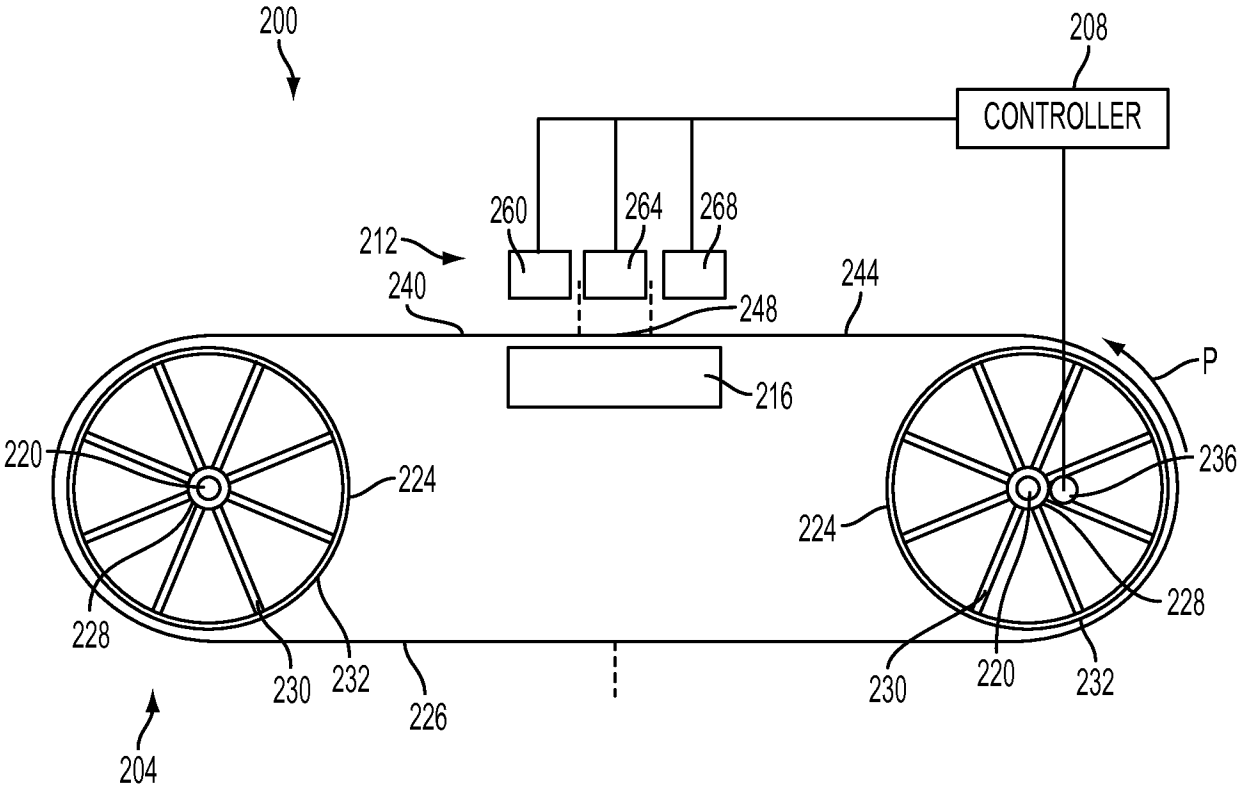
FIG. 4 is an end view of the intermediate imaging assembly of FIG. 3.

Turning now to FIG. 3 and FIG. 4, another embodiment of an intermediate imaging element assembly 200 is shown. The assembly 200 is substantially similar in structure and operation to the assembly 100 described above with reference to FIG. 1 and FIG. 2. Like the assembly 100, the assembly 200 includes a controller 208, a plurality of printheads 212, and a stationary receptacle 216 (visible in FIG. 4). However, unlike the assembly 100, the assembly 200 includes a belt arrangement 204 instead of an imaging drum 104.

The belt arrangement 204 includes two or more support members 220, two or more support rollers 224, and an endless belt 226. Each support member 220 is substantially identical to the support member 120 described above, and each support roller 224 that rotates about a support member is substantially identical to the surface member 124 described above. The endless belt 226 is entrained about the two support rollers 224 so as to be supported and rotated by the support rollers 224. In the present embodiment, the actuator 236 is configured to engage one of the hubs 228 of one of the support rollers 224.

However, the actuator 236 can engage both hubs 228 of the support rollers 224 or engage another portion of the support rollers 224 to rotate the members and drive the belt. To operate the belt arrangement 204, the controller 308 sends an electronic signal to the actuator 236 to rotate the support roller 224, which is engaged with the actuator 236 about the respective support member 220 in the process direction P. Because the belt 226 is entrained about the two support rollers 224, rotating the support roller 224 which is engaged with the actuator 236 also rotates the belt 226 relative to the plurality of printheads 212 and rotates the other support roller 224 about its respective support member 220.

Similarly to the circumferential wall 132 described above, the belt 226 includes a first area 240, a second area 244, and a third area 248, shown as separated from one another by dashed lines. The first area 240 and the second area 244 receive ink for the formation of ink images, and the third area 248, interposed between the first area 240 and the second area 244, receives ink that does not form an ink image. The third area 248 includes a plurality of apertures 252 (shown in FIG. 3) substantially identical to the apertures 152 described above.

Similarly to the plurality of printheads 112 described above, the plurality of printheads 212 includes twenty-seven printheads 256 arranged in three staggered rows 260, 264, 268 (shown in FIG. 4) of nine printheads each. Each printhead 256 has a corresponding front face including inkjets for ejecting drops of ink onto the belt member 226 of the belt arrangement 204. Each inkjet corresponds to an aperture 252 (shown in FIG. 3) in the third area 248 that is substantially identical to the apertures 152 described above. Each inkjet on a printhead 256 can be aligned with an aperture 252 such that drops of ink ejected by the inkjets pass through the apertures 252 and, therefore, through the belt member 226.

In the same manner as described above with respect to the controller 108, the controller 208 operates the actuator 236 and the inkjets in the plurality of printheads 212 so that inkjets selectively eject ink onto the first area 240, the second area 244, or the third area 248 of the belt 226. In one embodiment, the controller 208 is also configured to operate the inkjets in the printheads 256 to selectively eject ink into the apertures in the third area 248 at a predetermined rate. In another embodiment, the controller 208 is configured to accumulate time from when an inkjet in a printhead 256 was last operated to eject ink and then operate the inkjet to eject ink through an aperture in the third area in response to the accumulated time for the inkjet exceeding a predetermined threshold.

Figure 5:
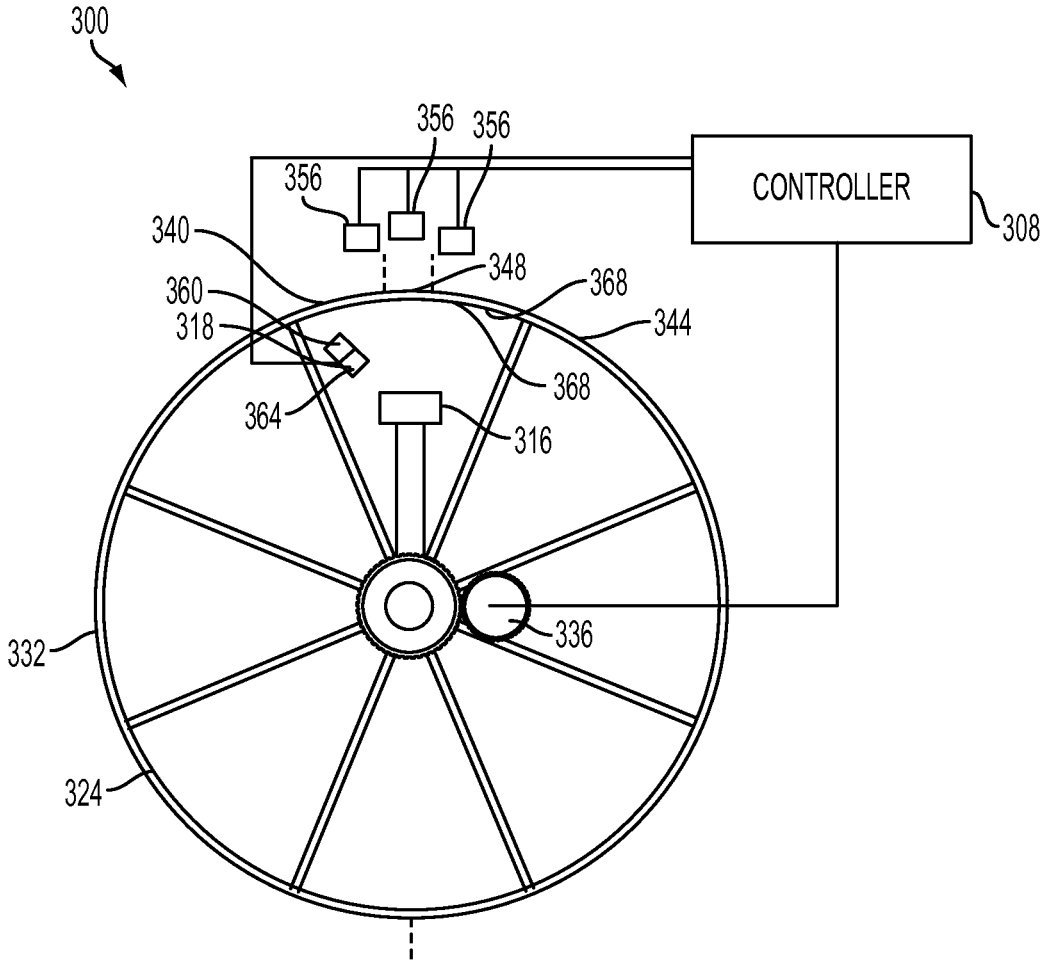
FIG. 5 is an end view of an alternative embodiment of the intermediate imaging assembly of FIG. 1.

In an alternative embodiment, shown in FIG. 5, the assembly 300 is substantially identical to the assembly 100, described above with reference to FIG. 1 and FIG. 2. The assembly 300, however, further includes an optical sensor 318. The optical sensor 318 is arranged within the circumferential wall 332 of the surface member 324 and is operably connected to the controller 308. The optical sensor 318 includes a light emitter 360 and a reflected light receiver 364. Light emitted from the emitter 360 of the optical sensor 318 is reflected by ink passing through the apertures (not shown, but substantially identical to those shown in FIG. 1) in the third area 348. Light not encountering ink passing through the apertures is not reflected into the light receiver 364. Accordingly, an image corresponding to the reflected light captured by the receiver 364 indicates the presence and location of ink drops passing through the apertures and these image data can be analyzed to identify missing ink drops and, thus, inoperative inkjets.

The controller 308 is configured as described above to operate the optical sensor 318 to emit light with the emitter 360 while simultaneously operating at least some of the inkjets in the printheads 356 to eject ink into the apertures in the third area 348 of the circumferential wall 332. By analyzing these image data corresponding to the reflected light, the controller 308 identifies whether an ink drop passed through the third area for each inkjet operated by the controller. When the controller 308 determines that no ink drop was detected for an inkjet that was operated, the controller identifies the inkjet as being inoperative. In the depicted embodiment, the optical sensor 318 is incorporated into an imaging drum 304. However, the optical sensor can also be incorporated in a belt arrangement such as the belt arrangement 204 described above. In other embodiments, the drop detecting sensor can detect missing or misdirected jets through electrical charge, permittivity, thermal, permeability, or the like techniques.

Figure 6:
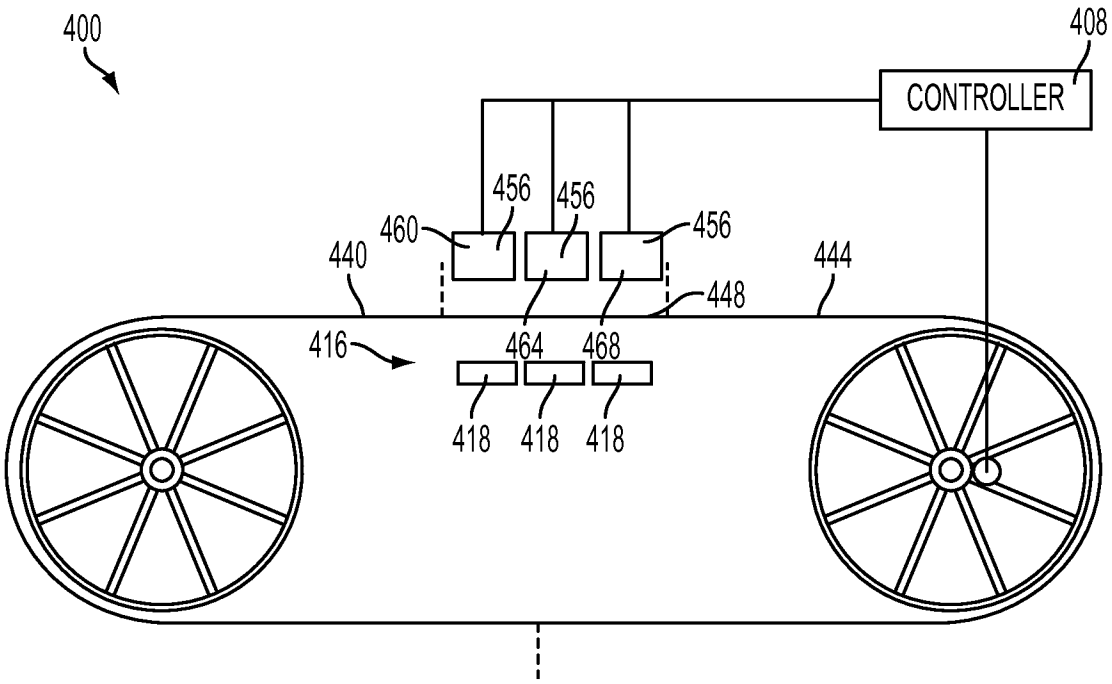
FIG. 6 is an end view of an alternative embodiment of the intermediate imaging assembly of FIG. 3.

In another alternative embodiment, shown in FIG. 6, the assembly 400 is substantially identical to the assembly 200 described above with reference to FIG. 3 and FIG. 4. The assembly 400, however, includes a plurality of stationary receptacles 416 in lieu of a single stationary receptacle 116. In the depicted embodiment, the plurality of stationary receptacles 416 includes one receptacle 418 for each printhead 456. Each receptacle 418 is positioned to accumulate ink ejected through apertures from a corresponding printhead 456. Alternatively, the plurality of stationary receptacles 416 can include one receptacle 418 for each row 460, 464, 468 of printheads. Each receptacle 418 is positioned to accumulate ink ejected through apertures from a corresponding row of printheads 456. In the depicted embodiment, the third area 448 is large enough such that all printheads 456 can be simultaneously operated to eject ink from inkjets through apertures into receptacles. The third area 448, however, can also be smaller as described above. In the depicted embodiment, the plurality of stationary receptacles 416 is incorporated into a belt arrangement 404. However, a plurality of stationary receptacles can also be incorporated into an imaging drum such as the imaging drum 104 described above.

While the receptacles discussed above are depicted as trays, other types of receptacles could be used as well. For example, a roller 704 wrapped in an absorbent material 708 could be placed at a position corresponding to the receptacles discussed above. As shown in FIG. 7, an actuator 716 is operatively connected to the support member 712 of the roller 704 to index or turn the roller when the absorbent material is saturated or close to saturation with ink ejected through the apertures. The controller 720 operatively connected to the actuator 716 can advance the roller 704 in response to an accumulated count of ink drops ejected through the apertures reaching a predetermined threshold or an ink sensor 724 can be positioned to detect ink in the absorbent material 708 of the roller 704. The accumulated ink drop count can be identified through the data used to operate the printheads to eject ink drops through the apertures or received from the printhead controller, if different than controller 720. In the embodiment using a sensor, the controller 720 advances the roller 704 in response to the sensor 724 sending an electrical signal to the controller that indicates the absorbent material 708 presently positioned to receive ink drops is saturated or nearly saturated. When the roller has been rotated 360 degrees, the controller 720 generates a message or activates an alarm that indicates the roller 704 needs replacement. Upon replacement of the roller, the controller 720 resets the accumulated drop count, if the count is being used to index the roller, to enable detection of a saturated or nearly saturated area on the roller. The controller also resets the roller index so rotation of the roller through another 360 degree cycle can be monitored. Additionally, the roller could have a blade 730, shown in phantom in FIG. 7, which can be operated by the controller to contact the roller and direct dried ink from the material 708 wrapped about the roller into a sump 734 for collection and occasional removal.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

at least one printhead configured with a plurality of inkjets to eject ink drops;

at least one support member positioned opposite the at least one printhead;

a substrate configured for rotation about the support member to enable the substrate to pass by the at least one printhead in a process direction, the substrate including a first area in which ink drops ejected from the at least one printhead form a first ink image on the substrate for transfer to media and a second area having a plurality of apertures configured to enable ink drops ejected from the at least one printhead to pass through the substrate, the second area extending across a width of the substrate in a cross-process direction and along a portion of the substrate in the process direction to interrupt the first area;

a stationary receptacle positioned on a side of the substrate that is opposite a side of the substrate facing the at least one printhead, the stationary receptacle also extends across the substrate in a cross-process direction and is configured to accumulate ink drops ejected by the at least one printhead that passed through apertures in the plurality of apertures in the substrate; and a controller operatively connected to the at least one printhead, the controller being configured to operate inkjets within the at least one printhead that have not ejected at least one ink drop within a predetermined time period to eject ink drops only from the inkjets in the at least one printhead that have not ejected at least one ink drop within the predetermined time period through the apertures in the second area opposite the inkjets in the at least one printhead that have not ejected at least one ink drop within the predetermined time period to replace ink in nozzles of the inkjets in the at least one printhead that have not ejected at least one ink drop within the predetermined time period.

2. The printer of claim 1, the at least one support member further comprising:

at least two rollers;

the substrate being an endless belt entrained about the at least two rollers; and the stationary receptacle being interposed between the at least two rollers.

3. The printer of claim 1, wherein the apertures in the plurality of apertures are arranged in staggered rows of apertures.

4. The printer of claim 1, the substrate further comprising:

a hollow cylinder having a circumferential wall and open ends, the circumferential wall rotating about the support member to form a rotating drum; and the stationary receptacle is positioned within an interior of the hollow cylinder.

5. The printer of claim 1 further comprising:

an optical sensor positioned on the side of the substrate that is opposite the side of the substrate facing the at least one printhead, the optical sensor being configured to generate image data of ink drops passing through the apertures in the plurality of apertures; and a controller operatively connected to the at least one printhead and optical sensor, the controller being configured to operate inkjets within the at least one printhead to eject ink drops through at least a portion of the apertures and to identify inoperable inkjets with reference to the image data received from the optical sensor.

6. The printer of claim 1 further comprising:

a plurality of printheads; and a plurality of receptacles, each receptacle being positioned opposite a printhead in the plurality of printheads in a one-to-one correspondence.

7. The printer of claim 6 further comprising:

a controller operatively connected to each printhead in the plurality of printheads, the controller being configured to operate inkjets within each printhead that have not ejected at least one ink drop within a predetermined time period to eject ink drops only from the inkjets within each printhead that have not ejected at least one ink drop within a predetermined time period through the apertures in the second area that are opposite the inkjets within each printhead that have not ejected at least one ink drop within a predetermined time period into the receptacle positioned opposite the printhead.

8. A method of operating a printer comprising:

operating at least one printhead to eject ink drops;

rotating a substrate about a support member to enable the substrate to pass by the at least one printhead in a process direction, the substrate including a first area in which ink drops ejected from the at least one printhead form a first ink image on the substrate for transfer to media and a second area having a plurality of apertures that enable ink drops ejected from the at least one printhead to pass through the substrate, the second area having a width in a cross-process direction that extends substantially across the substrate and a length in the process direction to interrupt the first area;

counting a time period since a last ink drop ejection for each inkjet in the at least one printhead;

operating with the controller to eject ink drops only from the inkjets in the at least one printhead for which the counted time period since a last ink drop ejection is greater than a predetermined time period through the apertures in the plurality of apertures in the second area that are opposite the inkjets in the at least one printhead for which the counted time period since a last ink drop ejection is greater than a predetermined time period; and accumulating ink drops ejected by the at least one printhead that passed through apertures in the plurality of apertures in the substrate in a stationary receptacle positioned on a side of the substrate that is opposite a side of the substrate facing the at least one printhead.

9. The method of claim 8, the rotation of the substrate further comprising:

rotating an endless belt entrained about at least two rollers, and the stationary receptacle is interposed between the at least two rollers.

10. The method of claim 8, the rotation of the substrate further comprising:

rotating a hollow cylinder having a circumferential wall and open ends about the support member, and the stationary receptacle is positioned within an interior of the hollow cylinder.

11. The method of claim 8, the operation of the inkjets further comprising:

operating with the controller the inkjets for which the counted time period since a last ink drop ejection is greater than a predetermined time period with the controller at a predetermined rate to remove ink from nozzles in the inkjet ejectors for which the counted time period since a last ink drop ejection is greater than a predetermined time period.

12. The method of claim 8 further comprising:

generating image data of ink drops passing through the apertures in the plurality of apertures with an optical sensor positioned on the side of the substrate that is opposite the side of the substrate facing the at least one printhead;

operating inkjets within the at least one printhead with a controller to eject ink drops through at least a portion of the apertures; and identifying inoperable inkjets with the controller with reference to the image data received from the optical sensor.

* * * * *